US005915442A

United States Patent [19]

Prosch

[11] Patent Number: 5,915,442

[45] Date of Patent: Jun. 29, 1999

[54] CURTAIN, MORE PARTICULARLY, A WINDOW SHADE

[76] Inventor: Dieter Prosch, Flachsland 39, 22083 Hamburg, Germany

[21] Appl. No.: 08/809,125

[22] PCT Filed: Jul. 8, 1996

[86] PCT No.: PCT/EP96/02984

§ 371 Date: Mar. 14, 1997

§ 102(e) Date: Mar. 14, 1997

[87] PCT Pub. No.: WO97/17876

PCT Pub. Date: May 22, 1997

[30] Foreign Application Priority Data

Nov. 15, 1995 [DE] Germany ..... 296 18 057 U

[51] Int. Cl.[6] ..... E06B 3/48

[52] U.S. Cl. ..... 160/84.01; 160/330; 160/368.1

[58] Field of Search ..... 160/170 R, 330, 160/84.01, 368.1

[56] References Cited

FOREIGN PATENT DOCUMENTS 0520955 12/1992 European Pat. Off. .

3714105 9/1988 Germany .

3931090 3/1991 Germany .

4439423 7/1995 Germany .

*Primary Examiner*—Blair M. Johnson

*Attorney, Agent, or Firm*—Friedrich Kueffner

[57] ABSTRACT

In order that the tensile forces caused by the weight of the curtain do not act upon the adhesive closing tape employed for the affixation of the curtain fabric to a mounting track rigidly connected with the building, but are instead conducted into the anchoring system on the building, a curtain, more particularly a window shade, is provided with guiding and deflecting elements for the drawing cords fitted to the curtain fabric, in which the curtain fabric carrying attachment plates (20) with rings or eyes (21) is affixed with the aid of an adhesive closing tape (40) of a fleece tape (41) and a Velcro fastener tape (141) to a mounting track (10) rigidly connected with the building constructed in such a way that the attachment plates (20) for the establishment of a frictional, operative connection with the mounting track (10) are connected by means of detachable supporting and connecting elements (30) that absorb vertical tensile forces, while the attachment plates (20) and the mounting track (10) are provided with the parts (41,141) forming the adhesive closing tape (40) (FIG.1).

22 Claims, 17 Drawing Sheets

CURTAIN, MORE PARTICULARLY, A WINDOW SHADE

The invention relates to a curtain, more particularly a window shade, with guiding and deflecting elements fitted to the curtain fabric for the drawing cords, in which the curtain fabric carrying attachment plates with rings and eyes is fastened with the aid of an adhesive closing tape to a mounting track rigidly anchored in the building.

BACKGROUND OF THE INVENTION

From the DE 37 14 105, a window shade with guiding and defelcting elements for the drawing cords attached to the curtain fabric is known, in which each deflecting element is comprised of an attachment plate connected to the curtain fabric , which, by preference, is integrally and rigidly connected with a guiding eye hanging down from the latter. The curtain material supporting the attachment plate with the eye is secured with the aid of a textile adhesive closing tape. Consequently, the shade is fixed on the mounting track with the aid of an adhesive closing tape comprising a fleece tape and a Velcro fastener tape. The attachment plates with the eaye for the drawing cords are in this case on a portion—fleece tape or Velcro fastener tape—of the adhesive closing tape which, in turn, is brought into adhesive connection with the other portion that is secured to the mounting track. However, this constructional design can only be employed with lightweight curtain fabrics. When heavy curtain material is used, the tensile load given rise to by the great weight acts upon the adhesive connection with the result that, on account of the strong traction, the fleece tape becomes detached from the Velcro fastener tape of the adhesive closing tape.

The technical problem of the present invention is to provide, in a curtain or shade of the type stated in the beginning, an attachment in which also use is made of an adhesive closing tape for heavy curtain fabrics, wherein the tensile forces given rise to by the weight of the shade do not act upon the adhesive closing tape, but are conducted into the mounting system on the building.

This technical problem is resolved by the features characterized in the Claim 1.

SUMMARY OF THE INVENTION

According to this the invention consists in that the attachment plates for the production of a frictional operative connection with the mounting track anchored in the building are connected via detachable supporting and connecting elements absorbing vertical tensile loads.

These supporting and connecting elements are comprised of a horizontally proceeding web attached to or formed onto each attachment plate and of an engagement groove formed on the attachment plate and of an engagement groove formed on the mounting track and proceeding in the longitudinal direction of the mounting track for the webs of the attachment plates. By means of the engagement of the webs of the attachment plates into the engagement groove on the mounting track, a frictional connection is provided and the tensile loads otherwise acting upon the adhesive closing tape are conducted via the supporting and connecting elements into the mounting track and thus absorbed by the wall of the building on which the mounting track is anchored. In this way an inadvertent detachment of the adhesive closing tape is avoided since the tensile loads or forces given rise to by the weight of the curtain or shade are no longer conducted into the adhesive closing tape. Consequently, no tensile load acts upon the adhesive closing tape any longer.

Advantageous constructions of the invention are characterized in the subclaims.

Here the constructional design of the mounting track is especially advantageous, which possesses a web-like cross-sectional configuration that is comprised of a first channel section with horizontally proceeding legs and of a web interconnecting the latter, in which case the upper horizontal leg is carried with one section beyond the leg connecting web and the free ends of the legs possess angled sections facing one another, and of a second section proceeding parallel to the first section, formed onto the free end of the lower leg of the first channel section, in which case the first section, on its free end, possesses a third channel section forming the engagement groove for the webs of the attachment plates with an outwardly directed engagement aperture for the attachment plate webs, and wherein the third section extended on both sides relative to the first web section and the free bottom end of the second section possesses sections which face each other while forming an opening, in which case the apertures constructed in the mounting track serve for the accommodation of the mounting means for the winding shaft of the curtain fabric and for the anchoring means for the mounting track on a building wall.

A further embodiment of the invention consists in that each deflecting element is comprised of an attachment plate connected rigidly or detachably with the curtain material proper, which, for its part, is rigidly connected to a guiding eye hanging down from the same and is fabricated in one piece with the latter, a two-piece construction being also possible in this case.

The invention further relates to a curtain or shade, more particularly comprised of a mounting track which can be anchored in a wall or in the ceiling of a room with a curtain or shade affixed to its upper border edge and with several groove-like guideways proceeding in the longitudinal direction of the mounting rail for the accommodation of at least two reel housings or mounting means with one winding shaft each proceeding transversally to the longitudinal direction of the mounting track, carrying a sprocket wheel on one end and an endless operating chain that is operatively connected to the sprocket wheels of the winding shafts, connected with a drive means and deflected on the one end of the mounting track and for the accommodation of the chain strands of the operating chain, in which case the winding shafts that are operable by means of the operating chain, in which case the winding shafts serve for the winding up of drawing cords, which, with one of their ends, are secured to the winding shafts and, with their other ends, to the bottom border edge of the curtain or shade as well as being passed through guide loops disposed so as to be distributed on the same.

In this curtain or shade, according to a first embodiment, on the underside of the mounting track, at least two first reel housings with winding shafts and sprocket wheels are disposed for the drawing cords fitted to the bottom border edge of the curtain for gathering and drawing the curtain, in which case the sprocket wheels of the winding chains of the first reel housings are to be found on one of the two longitudinal sides of the track and are in operative connection with a first endless operating chain with chain strands carried in guideways of the mounting track. The guidance of the first operating chain is such that the same proceeds with an operating chain section parallel to the vertical longitudinal lateral edge of the curtain. In addition, on the underside of the mounting track, a second reel housing is disposed having a winding shaft and a sprocket wheel for a drawing cord attached to the bottom border edge of the curtain for the fan-like gathering of the curtain. The sprocket wheel of the winding shaft of this second reel housing is located on the longitudinal side facing away from the sprocket wheels of the winding shafts of the first reel housings. The sprocket wheel of the winding shaft of the second reel housing is operatively connected with a second endless operating chain with the chain strands carried in guideways of the mounting track. This disposition and the guidance of this second operating chain section is such that the same, with a section of the operating chain which proceeds parallel to the vertical longitudinal edge of the curtain, comes to be located on that side of the curtain on which also the operating chain section of the first operating chain proceeds so that an operation of the curtain takes place by means of operating chain sections located on one side of the curtain. The first operating chain serves for the gathering and the drawing of the curtain, while with the aid of the second operating chain, the curtain is actuated in such a way that a fan-like gathering of the curtain is possible, while by means of a reversal of the direction of movement of the operating chain, the fan-like gathering of the curtain can be cancelled.

According to a further embodiment of the invention, the window shade does possess approximately the same construction and disposition as described in the foregoing, however, the operating chains with their operating chain sections are guided in such a way that one of the operating chain sections comes to be located on the one side of the curtain and the other operating chain section on the other side of the curtain so that the operation of the operating chains has to be performed on two different sides of the shade.

Since the reel housings with the winding shafts and the sprocket wheels are constructed in an identical fashion, the reel housings may be placed on the left-hand side at one time and on the right-hand side at another time on the underside of the mounting track, where they are retained by force fit in the guiding/mounting means provided in the mounting track in such a way that both a detachment as well as a displacement of the reel housings from and on the mounting track is possible. However, the disposition of the reel housings on the mounting track is such in this case that, in the attached or inserted position, the reel housings are at the same time locked on the mounting track against any displacement so as to avoid that, when the sprocket wheels of the winding shafts of the reel housings are actuated with the aid of the operating chains, the reel housings become automatically displaced on the mounting track.

The possibility of, on the one hand, gathering and drawing a curtain and, on the other hand, of also gathering the same curtain in a fan-like manner is achieved in that the reel housings provided for the gathering and drawing of the curtain are disposed on the mounting track in such a fashion that the sprocket wheels of the winding shafts of all these reel housings are located on a longitudinal side of the mounting track. The reel housing responsible and provided for the fan-like gathering are then disposed in such a way that their sprocket wheels of the winding shafts for the corresponding length of the chain are located on the other longitudinal side of the mounting track so that the two operating chains which actuate the sprocket wheels proceed parallel to the two longitudinal sides of the mounting track. In this case as disposition of the two operating chains is possible in such a way that the chain strands of each operating chain are located above each other and, at the end of the mounting track, are deflected accordingly; in which case, however, also according to another embodiment, the chain strands of each operating chain proceed side by side and likewise rotate on the end of the mounting track so that the two operating chains with their chain strands are located so as to be superposed in two planes.

By means of the operating chains and by their engagement into the sprocket wheels in the reel housings, the winding shafts are set in rotation and, depending on the direction of rotation of the winding shafts, the drawing cords secured to the bottom border edge of the curtain are rolled up or unrolled.

By virtue of this construction it is possible, with a curtain according to the type described in the beginning, not only to both gather and to draw the curtain, but also to gather and to draw the same in a fan-like fashion.

Furthermore, the invention provides a construction, according to which the curtain, on its rear, possesses at least one drawing cord passed in a U-like manner through two guide rings affixed to the curtain adjacent to the top border edge of the same with two drawing cord sections proceeding transversally to the winding shaft and, with their free ends, secured to the bottom border edge of the curtain and with a drawing cord section formed between the two guide rings proceeding parallel to the winding shaft interconnecting the drawing cord sections, and in that the winding shaft, on its circumference, carries at least one pin or peg or hook-like drawing cord carrier located with its rotational area within the region of the drawing cord section, which, in the drawn state of the curtain, is out of engagement with the drawing cord connecting section and which, for the winding up of the drawing cords onto the winding shaft during the gathering procedure of the curtain, seizes the drawing cord connecting sections while the winding shaft is in rotation.

With a window shade designed in such a way the possibility exists for the first time of both disengaging and of establishing an operative connection between the drawing cords of the curtain and the winding shaft without an expensive technique being necessary for this. In the drawn state of the curtain, the drawing cord carrier on the winding shaft is not in engagement with the drawing cord routed in a U-like manner on the rear of the curtain, while already at the beginning of the rotational movement of the winding shaft, the drawing cord carrier seizes the drawing cord with its section located within the area of the winding shaft so that, in a further rotation of the winding shaft, the drawing cord seized by the drawing cord carrier is wound onto the winding shaft, in which case the curtain is gathered at the same time.

The operative connection between the drawing cord and its winding shaft is controlled by the direction and the movement of rotation of the winding shaft so that, in the drawn state of the curtain, the same can be effortlessly separated from the mounting track. The detachable fixation of the curtain to the mounting track is advantageously effected by means of a Velcro fastener-like constructed connection so that not only the detachment of the curtain from the mounting track can be carried out without effort by anyone. On account of the construction of the window shade according to the invention, the drawing cords need no longer be individually detached from the winding shaft or connected to the same. Merely a U-configured routing of the drawing cords on the curtain and a drawing cord carrier on the winding shaft suffice to make such an advantageous window shade available for the owners and inhabitants of apartments or suchlike.

If the curtain of the window shade possesses a greater width, in that case a larger number of drawing cordalso be also be required.

However, what is essential at all times is that each drawing cord in a U-like fashion on the rear of the curtain and that, on the curtain, a plurality of guide rings is affixed in such a way that drawing cord sections proceeding parallel to the winding shafts are formed so that the same can be seized by the carrier on the winding shaft for the winding on procedure of the drawing cords. The disposition of the guide rings on the curtain is efected within the area of the winding shaft in such a way that the drawing cord sections proceeding parallel to the winding shaft are located within the area of rotational movement of the drawing cord carrier when the same is set in motion by means of the rotational movement of the winding shaft. Every drawing cord is constituted of a pair of drawing cords of drawing cords proceeding transversally to the winding shaft and of a drawing cord connecting section interconnecting these drawing cord sections within the area of the winding shaft. If several drawing cords routed in a U-like fashion are provided on the rear of the curtain, then their disposition is effected in such a way that the drawing cord sections formed between the guide rings on the curtain and proceeding parallel to the winding shaft of different lengths are located so close to one another that all these drawing cord sections can be seized by the drawing cord carrier.

Advantageous constructions of the invention are characterized in the subclaims.

BRIEF DESCRIPTION OF THE DRAWINGS

Embodiments of the invention are explained in greater detail in the following with the aid of the drawings. Thus

DESCRIPTION OF THE PREFERRED EMBODIMENT

Figure 1:
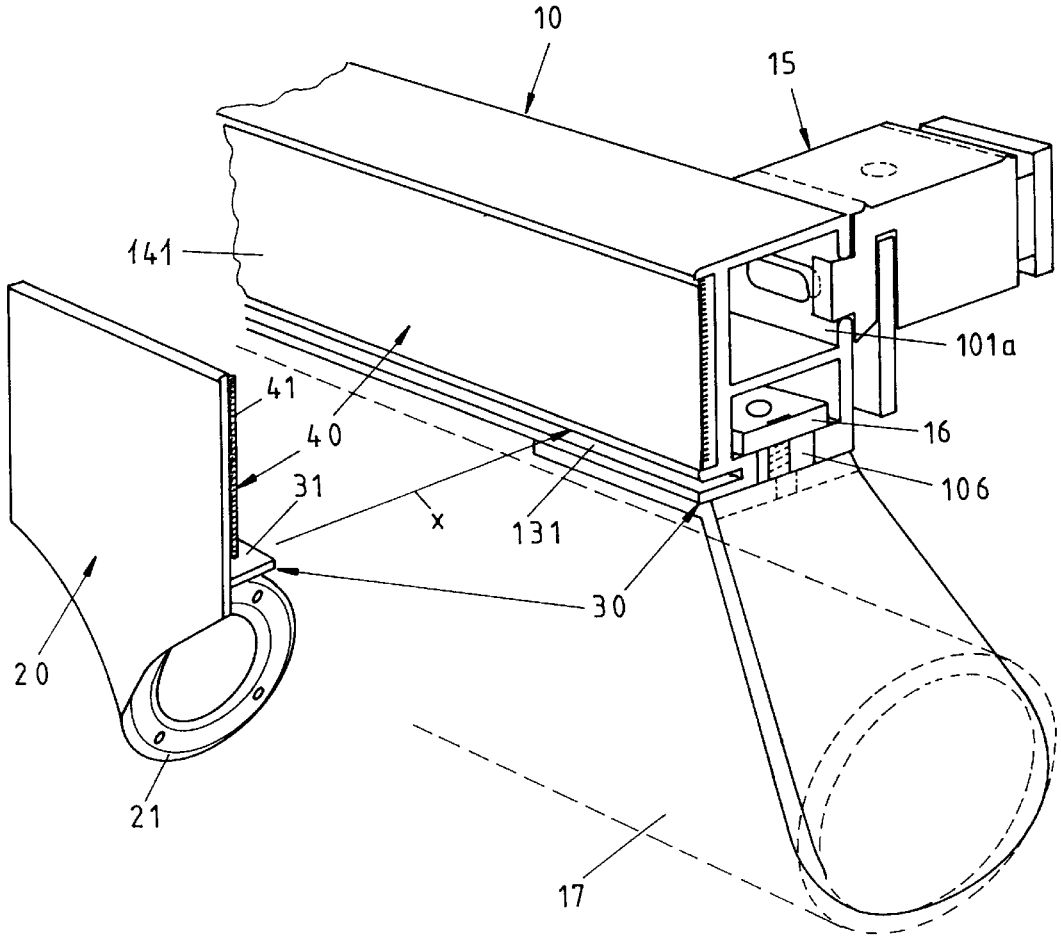
FIG. 1 shows in a diagrammatical view a section of the mounting track with a curtain fabric winding shaft mounted on the latter and with the fixation of the mounting track to a vertical building wall and with an attachment plate prior to the insertion of the web of the latter into the engagement groove on the mounting track.
Figure 6:
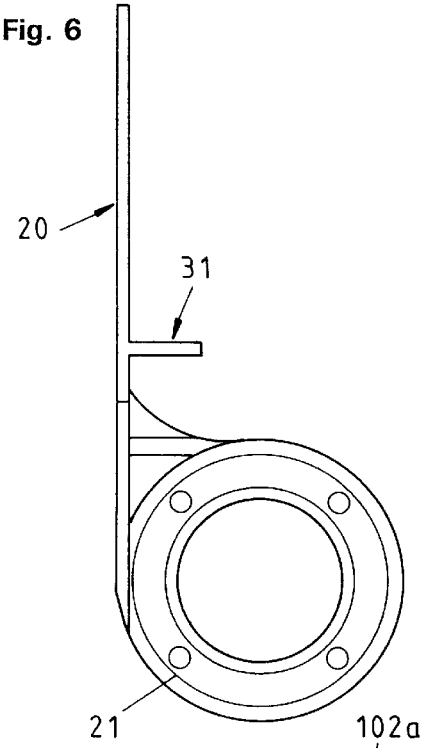
FIG. 6 shows in a side view the attachment plate with the web as part of the supporting and connecting elements.
Figure 7:
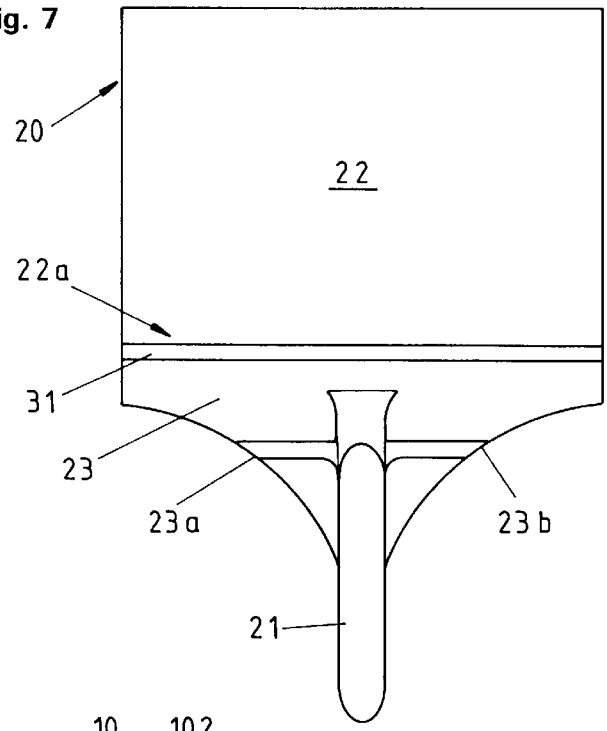
FIG. 7 shows a front view of the attachment plate.

A curtain, more particularly a window shade, not depicted in FIG.1, is provided with guiding and deflecting elements fitted to the curtain fabric for the drawing cords, which are constructed in the form of attachment plates 20. Each attachment plate 20 is, according to FIGS. 6 and 7, comprised of a plate-like area 22 which is approximately square, rectangular or possesses some other geometric configuration which, within its lower area 22*a*, possesses a horizontally proceeding web 31 which projects at a right angle from the attachment plate surface. The plate-like section 22 extends beyond the web 31 and runs out into an approximately triangular section 23, whose rims 23*a*, 23*b* are narrowed in an arcuate fashion. Onto this plate section 23, a ring or eye 21 disposed vertically to the attachment plate area is formed for the drawing cords not shown in the drawing.

Figure 2:
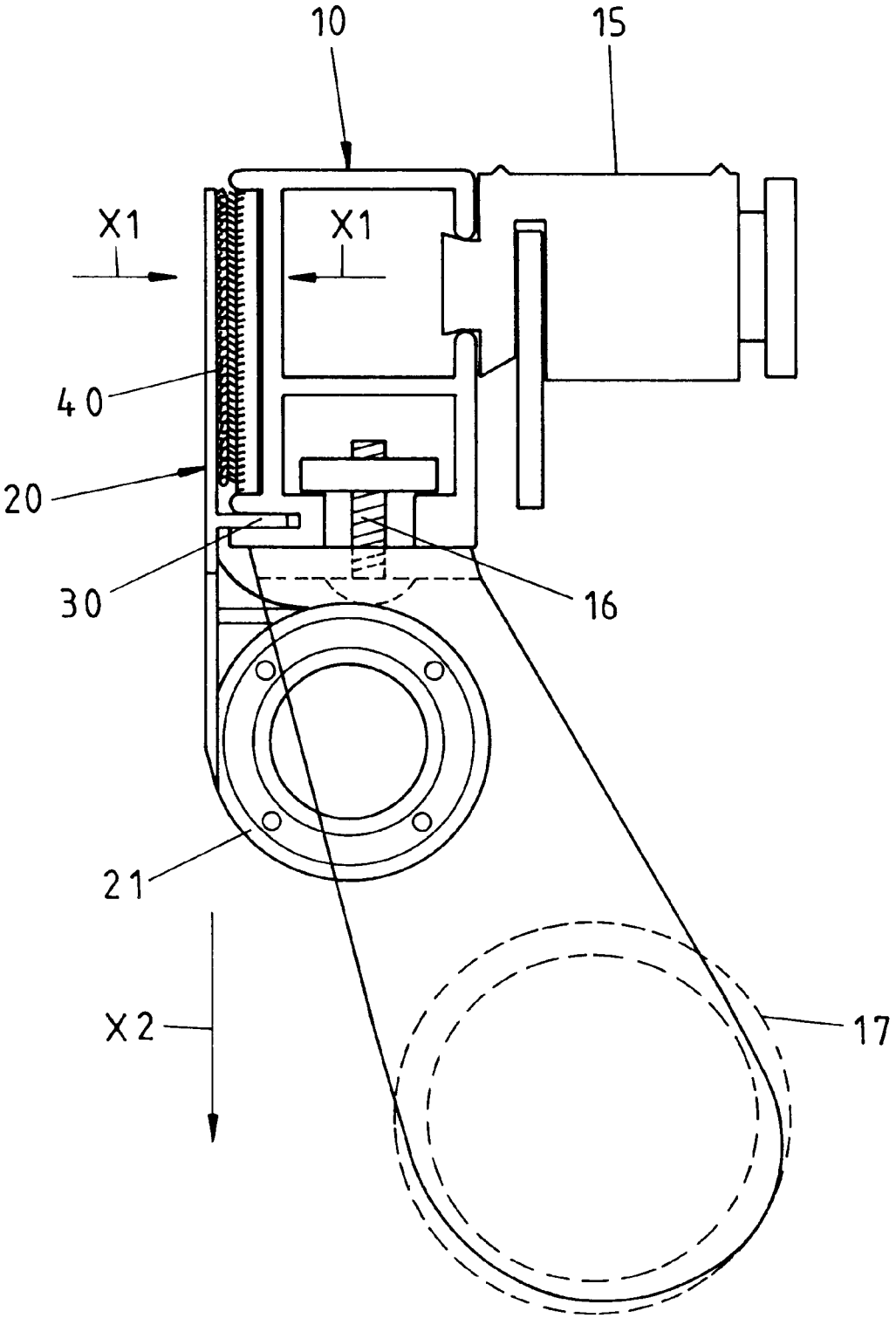
FIG. 2 shows in a side view the assembly as per FIG. 1, but with an attachment plate secured on the mounting track.

A mounting track 10 is provided for the fixation of the shade to a vertical wall, on which the attachment plates 20 fitted to the shade are fastened with the aid of an adhesive closing tape 40 (FIGS. 1 and 2).

Figure 9:
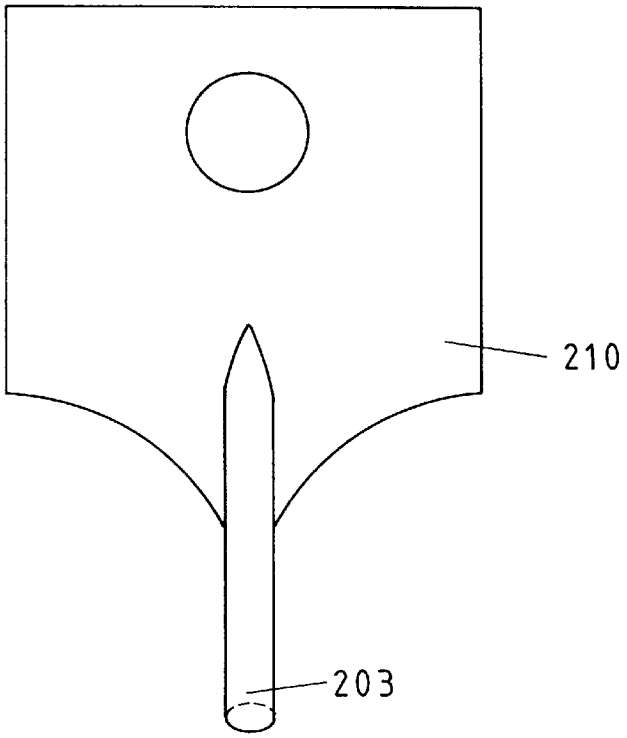
FIG. 9 shows a front view of an attachment plate with an eye as guiding and deflecting element for the drawing cords of the curtain.

The mounting track 10 possesses a web-like cross-sectional configuration 100, in which apertures 101*a* and 106 are constructed, of which the aparture 106 serves to accommodate the fastening means 16 for a shade winding shaft 17, while the other aperture 101*a* is provided with the fastening means 15 for anchoring the mounting track 10 on a vertical wall or a building ceiling (FIG.9).

Figure 4:
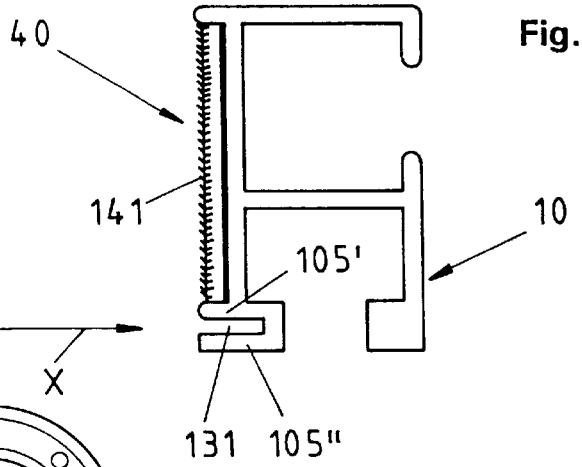
FIG. 4 shows in a side view the mounting track with the engagement groove for the attachment plate web and with a Velcro fastener tape disposed above the same as a further part of the adhesive closing tape.
Figure 5:
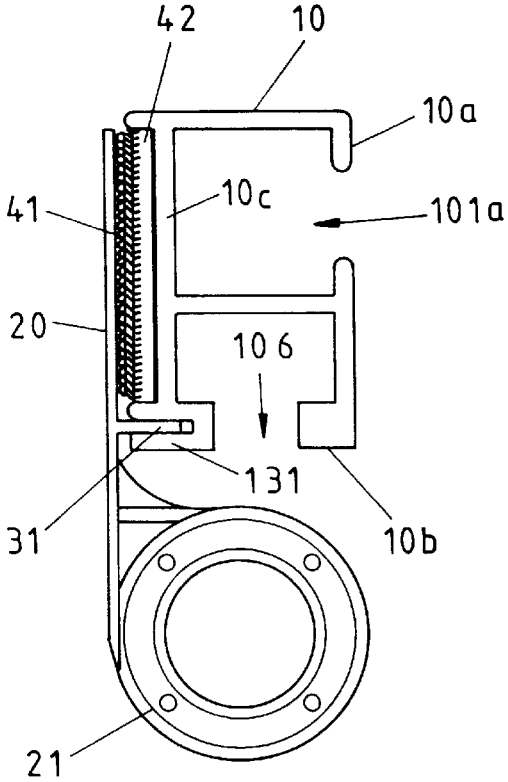
FIG. 5 shows in a side view the attachment plate fixed to the mounting track with the aid of the adhesive closing tape.

The fixation of the attachment plates 20 on the mounting track 10 is effected with the aid of an adhesive closing tape 40. This adhesive closing tape 40 is comprised of a fleece tape 41 and a Velcro fastener tape 141. In each embodiment depicted in the FIGS. 3 and 4, on the attachment plate 20, the fleece tape 41 of the adhesive closing tape 40 and, on the wall area of the mounting track 10 located opposite the attachment plate 20, the Velcro fastener tape 141 is affixed so as to form the second part of the adhesive closing tape 40 so that, when the attachment plate 20 is fastened to the mounting track 10, the fleece tape 41 enters into an adhesive connection with the Velcro fastener tape 141, which, if this is desired, is of a detachable nature (FIG. 5).

Figure 3:
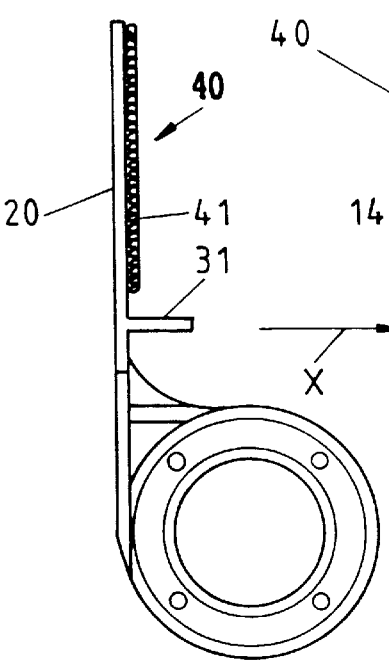
FIG. 3 shows in a side view an attachment plate with the engagement web and a fleece tape disposed above the same as part of the adhesive closure tape.

On the attachment plate connecting side, the mounting track 10 possesses an engagement groove 131 proceeding in the longitudinal direction of the mounting track, which comes to be located underneath the Velcro fastener tape 141 affixed to the mounting track 10. This engagement groove serves to establish the adhesive connection between the attachment plate 20 and the mounting track 10 for the accommodation of the web 31 on the attachment plate 20, which is fixed or formed on underneath the fleece tape 41 on the attachment plate 20. If, when the attachment plate 20 is mounted on the mounting track 10, the fleece tape 41 is attached to the Velcro fastener tape 141 for establishing the adhesive connection by the exertion of a light pressure in the direction of arrow X, the web 31 of the attachment plate 20 then engages simultaneously into the engagement groove 131 on the mounting track 10 (FIGS. 3,4 and 5).

When, as indicated by the arrows X1 in FIG.2, the adhesive connection established between the attachment plate 20 and the mounting track 10, in that case, by means of the web 31 and the engagement groove 131, a frictional connection between the attachment plate 20 and the mounting track 10 is established at the same time with the result that tensile forces occurring in the direction of arrow X2 are absorbed by the supporting and connecting element 30, which is formed by the web 31 and the engagement groove 131 (FIG.2).

The web 31 on the attachment plate 20 is secured above the ring or eye 21 and below the fleece tape 41 fixed on the attachment plate. The engagement groove 131 is fixed to the mounting track 10 underneath the Velcro tape 141 fitted to the same.

The web 31 on the attachment plate 20 can be formed or molded on at the same time during the fabrication procedure of the attachment plate. However, the possibility also exists of fitting the web 31 detachably to the attachment plate 20.

The depth of the engagement groove 131 on the mounting track 10 corresponds approximately to the width of the web 31 on the attachment plate 20. The height of the engagement groove 131 on the mounting track 10 corresponds approximately to the material thickness of the web 31 on the attachment plate 20 so that the web 31 introduced into the engagement groove 131 is clampingly retained by the wall areas or legs 105',105" delimiting the engagement groove (FIGS. 4 and 8).

The mounting track 10 possessing the engagement groove 131 is constructed in the form of a hollow section and, on two contiguous lateral surfaces 10*a*, 10*b*, is provided with one aperture 101*a* and 106 each proceeding in the longitudinal direction of the mounting track for the accomodation of attachment means 16,15 for the disposition of a winding shaft 17 for the shade fabric and for anchoring the mounting track 10 on a vertical building wall or building ceiling and possesses, on the lateral surface 10*c* located opposite the lateral surface 10*a*, the engagement groove 131 proceeding in the longitudinal direction of the mounting track (FIG.5).

Figure 8:
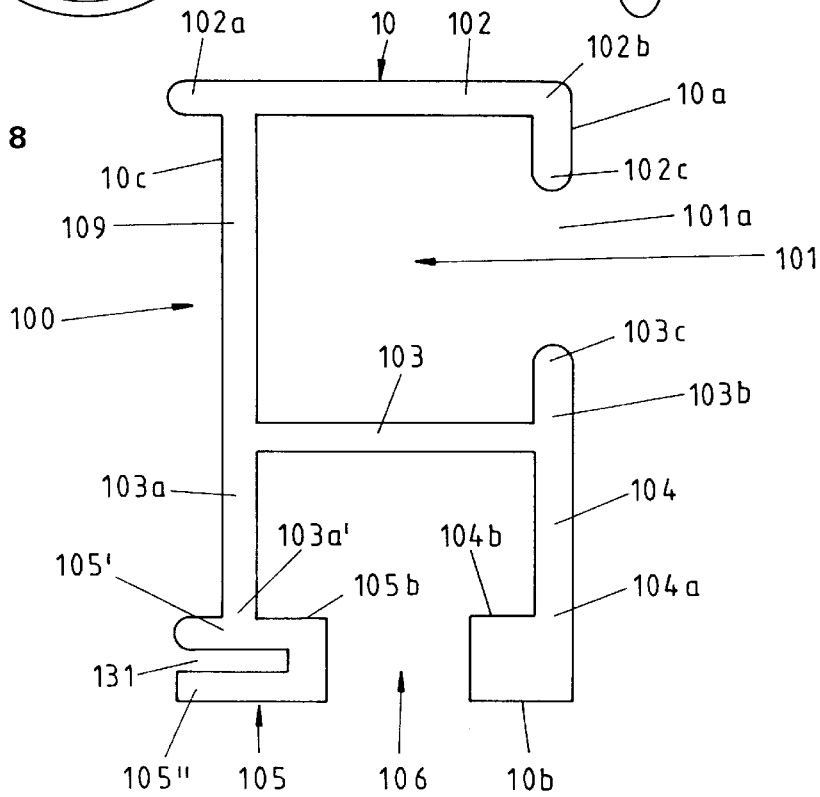
FIG. 8 shows a vertical cross-section through the mounting track.

According to the embodiment shown in FIG. 8, the mounting track 10 possesses a web-like cross-sectional configuration 100. This cross-sectional construction 100 is comprised of a first channel section 101 with horizontally proceeding legs 102,103 and a web 109 interconnecting the latter and extended with one section 103*a* beyond the lower leg 103, in which case the upper horizontal leg 102 is carried with a section 102a beyond the the leg connecting web 109 and the free ends 102*b*,103*b* of the legs 102,103 possess angled sections 102*a*,103*c* that face each other, and of a second section 104 proceeding parallel to the first section 103*a* , formed onto the free end 103*b* of the lower leg 103 of the first channel section 101, in which case the first section 103*a* , on its free end 103*a'*, possesses a channel-configured third section 105 forming the engagement groove 131 for the attachment plate webs 31, having an outwardly directed attachment plate web engagement opening. The third section 105 extended on both sides of the cross-sectional construction 100 of the mounting track 10 and the free lower end 104*a* of the second section 104, while forming an aperture 106, possesses sections 105*b*,104*b* that face one another. The upper section 102*a* extended beyond the leg connecting web 109 of the first channel-like section 101 and the section of the third channel-like configured section 105 extended beyond the first web section 103*a* possess lengths that correspond approximately to the material thickness of the Velcro fastener tape 141 of the adhesive closing tape affixed to the mounting track 10. However, other cross-sectional configurations of the mounting track 10 are also possible. The mounting track 10 has at least to be constructed in such a way that fixation means 15,16 for anchoring the mounting track on a building wall and for mounting the winding shaft for the curtain can be fitted, in which case, apart from the one part of the adhesive closing tape 40, also the engagement groove 131 is constructed on or in the cross-sectional structure 100 of the mounting track. The mounting track 10 with the attachment plates 20 fitted to the shade material, together with the adhesive closing tape 40 and the supporting and connecting elements 30 constituted of the web 31 and the engagement groove 131, form a closed unit.

Figure 10:
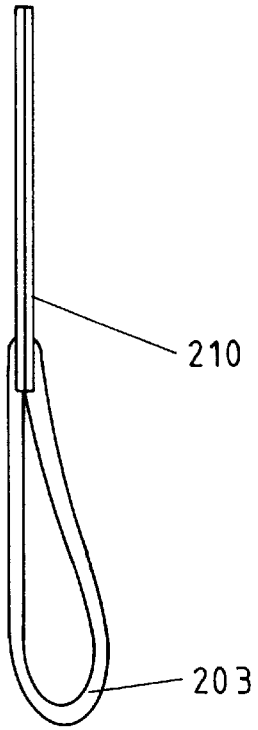
FIG. 10 shows a side view of the attachment plate as per FIG. 9.

In the embodiment as per FIGS. 9 through 21, according to FIGS. 9 and 10, an eye 203 is identified with an attachment plate 210 connected with the latter and with a curtain fabric 201.

Figure 11:
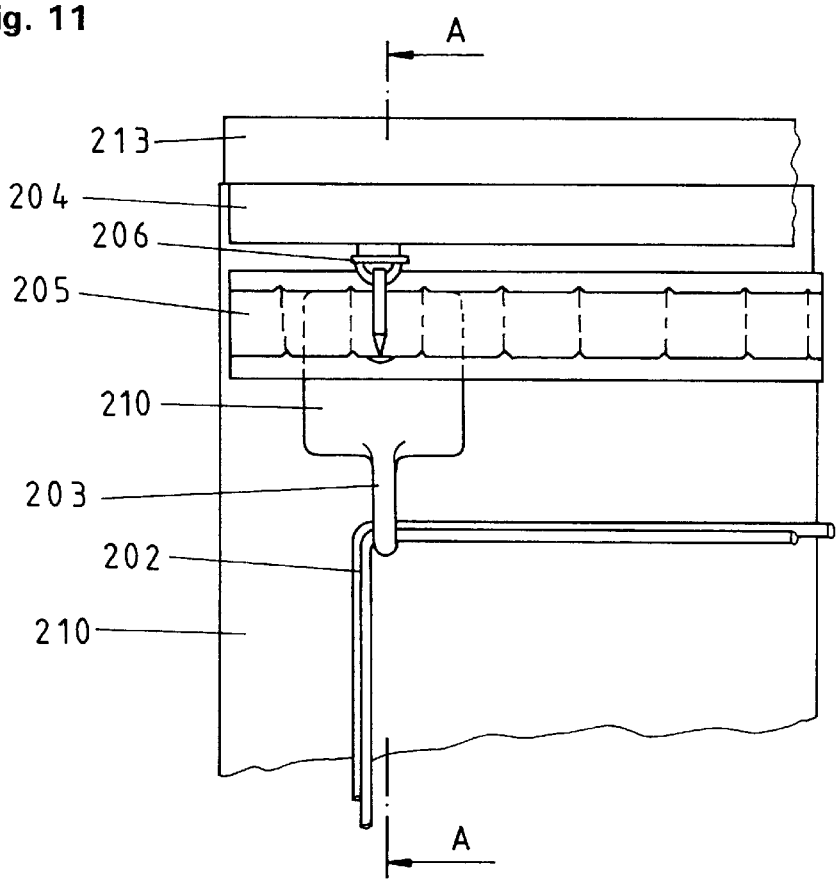
FIG. 11 shows in a front view a section of the curtain with the attachment plate and eye with a drawing cord passed through the same and deflected.
Figure 12:
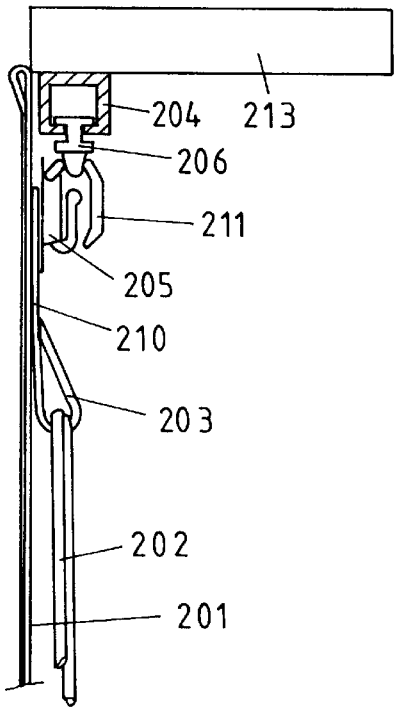
FIG. 12 shows a vertical section in the direction of line A—A in FIG. 11.

The FIGS. 11 and 12 depict an embodiment in which the attachment plate 210 connected with the eye 203 is fastened to and sewn in on a universal tape, e.g. a loop tape, which is hanging above hook 211 on slides 206, which slide in a travelling track 204 which is secured on a support 213 rigidly connected with the building.

Figure 13:
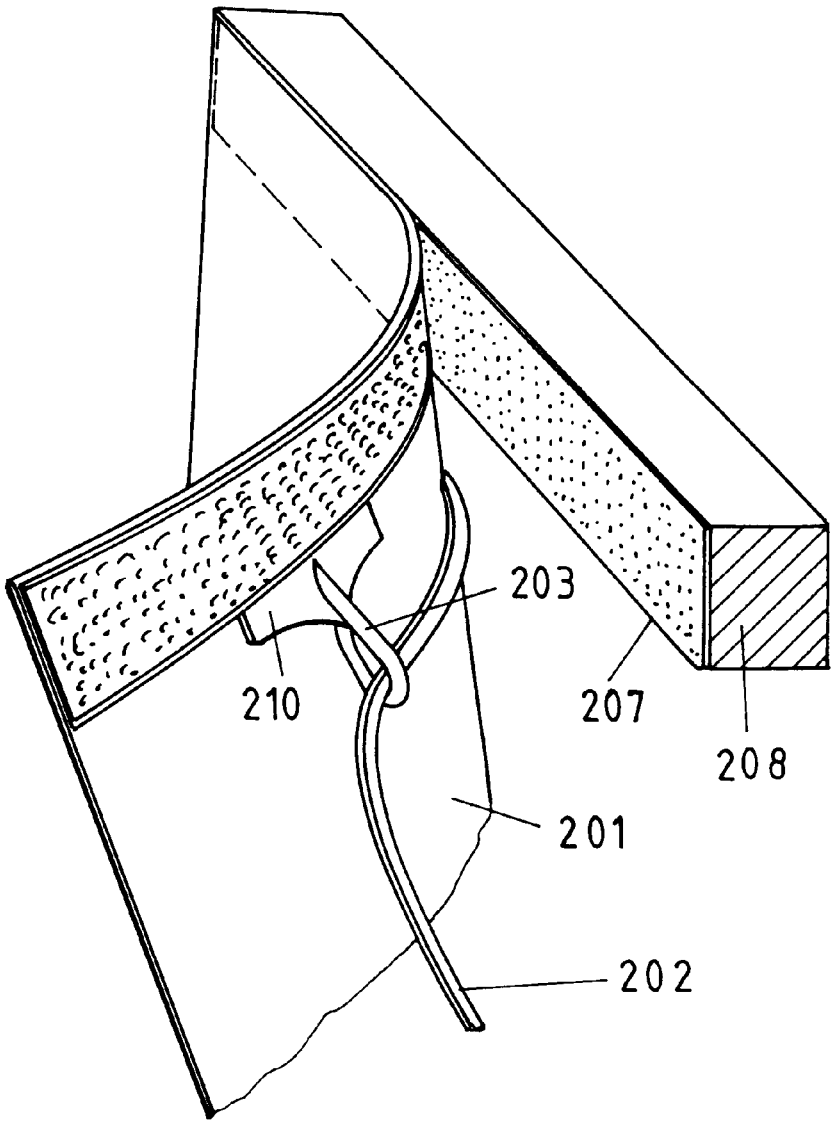
FIG. 13 shows a diagrammatical representation of an embodiment, wherein the curtain fabric carrying the attachment plate with the eye is secured to the mounting track with the aid of a Velcro fastener tape.
Figure 14:
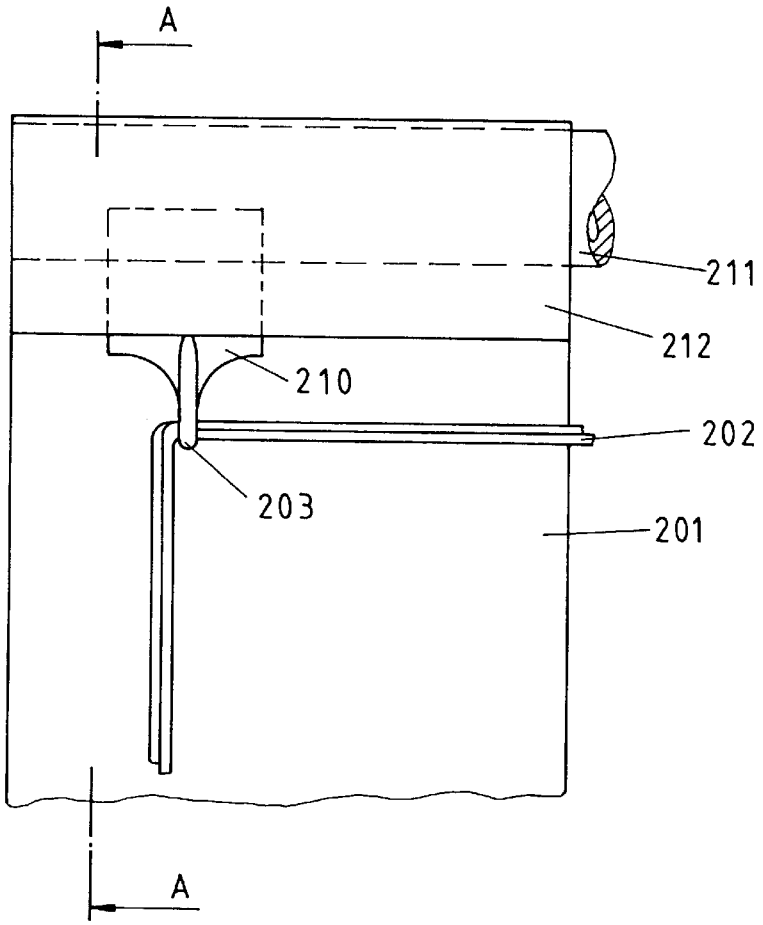
FIG. 14 shows a curtain in a front view, wherein the attachment plate with the eye is secured to the top end of the window shade material.
Figure 15:
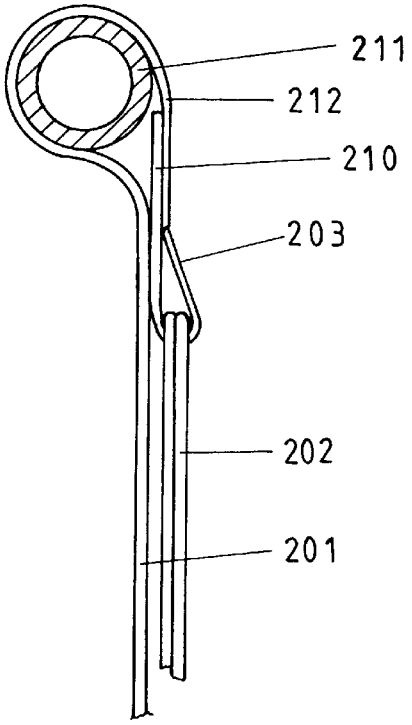
FIG. 15 shows a vertical section in the direction of line A—A in FIG. 14.
Figure 16:
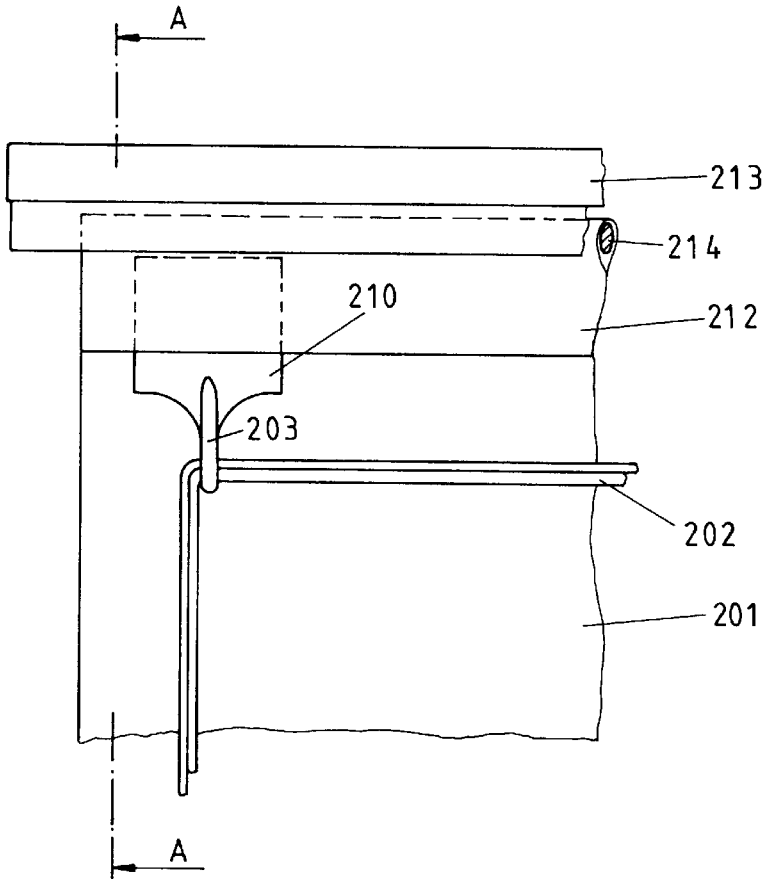
FIG. 16 shows in a front view another disposition of the curtain with the attachment plate and its eye.
Figure 17:
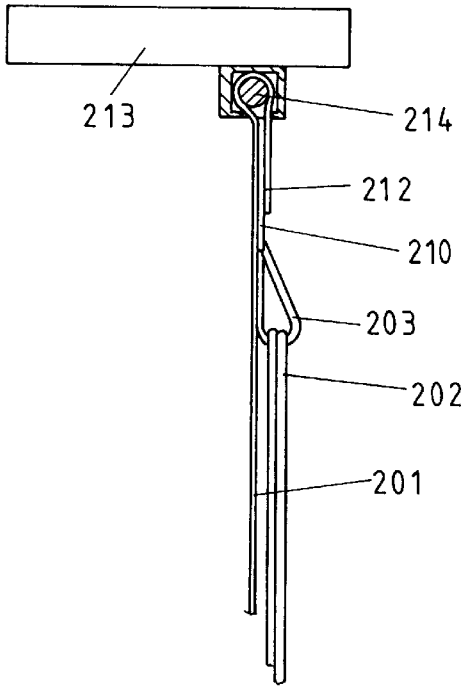
FIG. 17 shows a vertical section in the direction of line A—A in FIG. 16.
Figure 18:
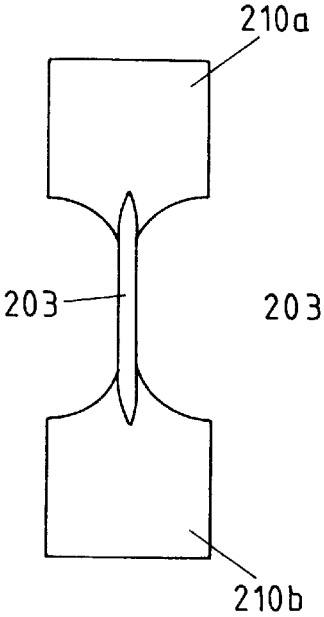
FIG. 18 shows a front view of an attachment plate comprised of two plate-like sections that are interconnected by means of a thin web.
Figure 19:
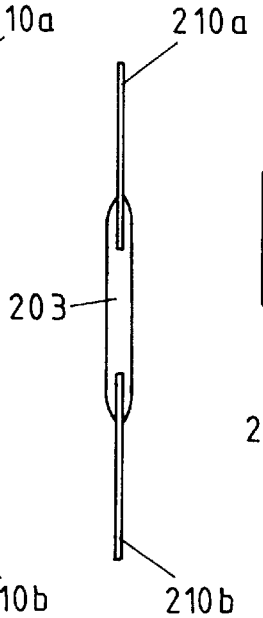
FIG. 19 shows a side view of the attachment plate as per FIG. 18.
Figure 20:
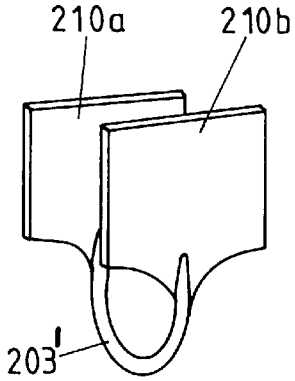
FIG. 20 shows a diagrammatical view of the attachment plate with plate-like sections folded together so as to form an eye by means of the web inter-connecting the sections.
Figure 21:
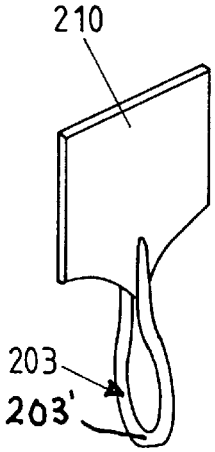
FIG. 21 shows in a diagrammatical view the two plate-like sections lying on top of one another with a formed eye.

In a perspective representation the FIG. 13 shows an embodiment, in which the curtain material 201 carrying the attachment plate 210 with the eye 203 is, with the aid of a textile adhesive closing tape 207, fixed on the strip 208 rigidly connected with the building.

FIGS. 14,15 and 16,17 relate to embodiments which resemble each other, in which the hitherto necessary space for eyes and rollers behind the window shade is no longer necessary. In these embodiments the attachment plate 210 is secured to the upper end of the window shade material 201 bearing the attachment plate 210 is secured to the upper end of the window shade material, which describes a loop 212 running across a rod 211 or a strip-like marginal reinforcement 214 are rigidly connected with the building, e.g. by means of the support 213.

The FIGS. 18 through 21 show the component parts of which the deflecting element is made up, viz. the eye 203 and the attachment plate 210. These figures illustrate the preformed parts consisting of flexible and washable plastic, preferably polyamide, from which, by folding the two terminal plates 210*a* and 210*b* and by welding the same together, the attachment plate 210 with the eye 203 is created.

Figure 22:
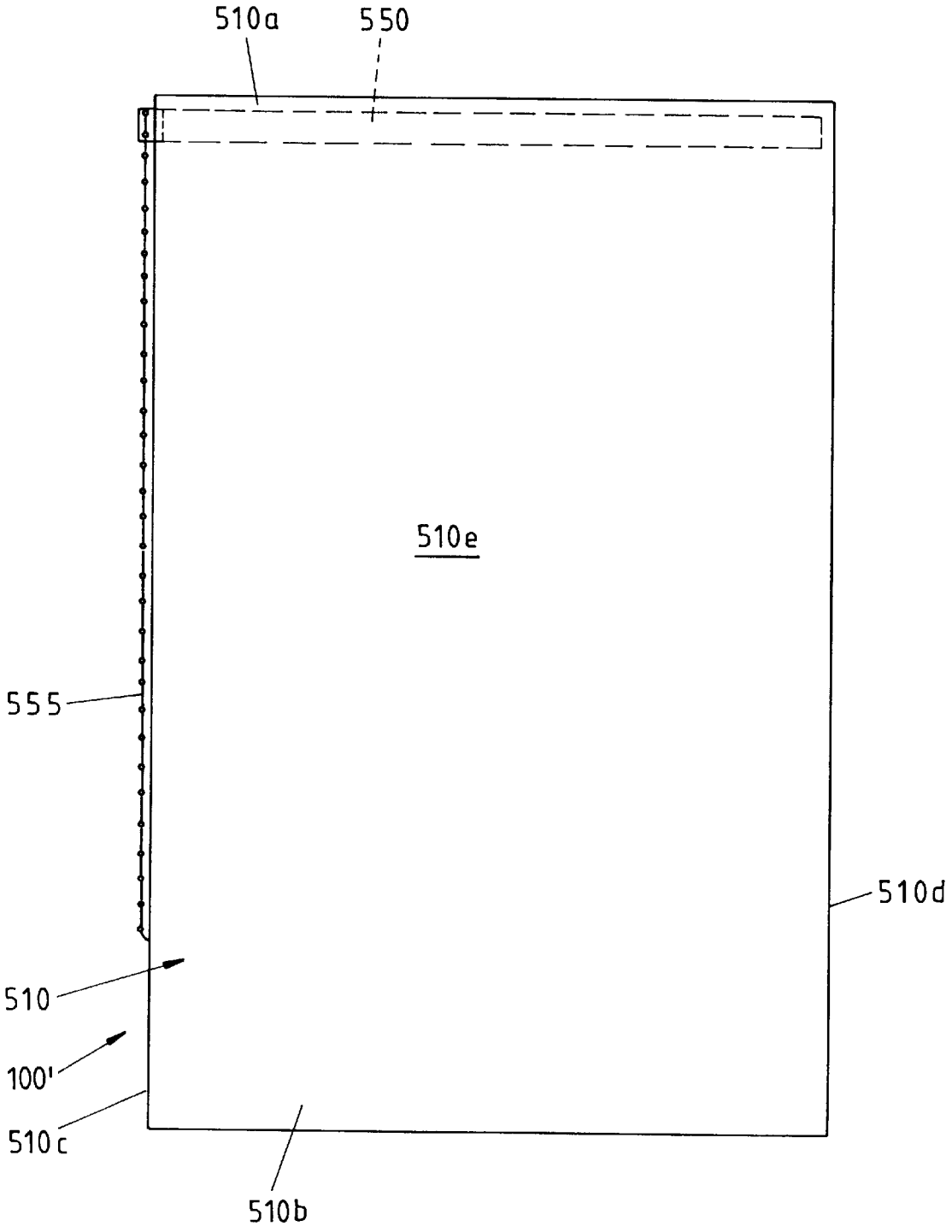
FIG. 22 shows a front view of the window shade with attachment plate and with the shade drawn.
Figure 23:
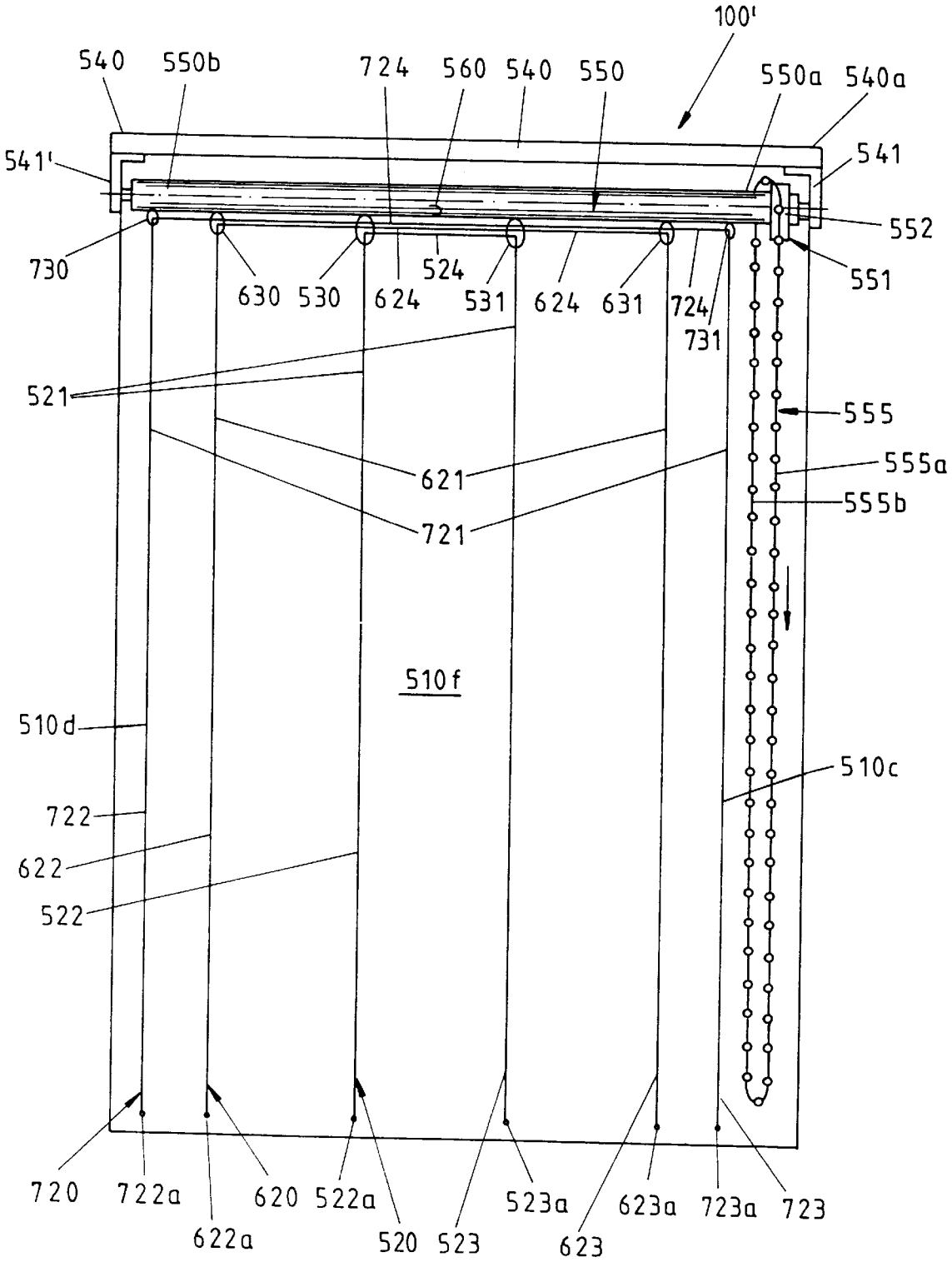
FIG. 23 shows a rear view of the window shade with the shade drawn.
Figure 24:
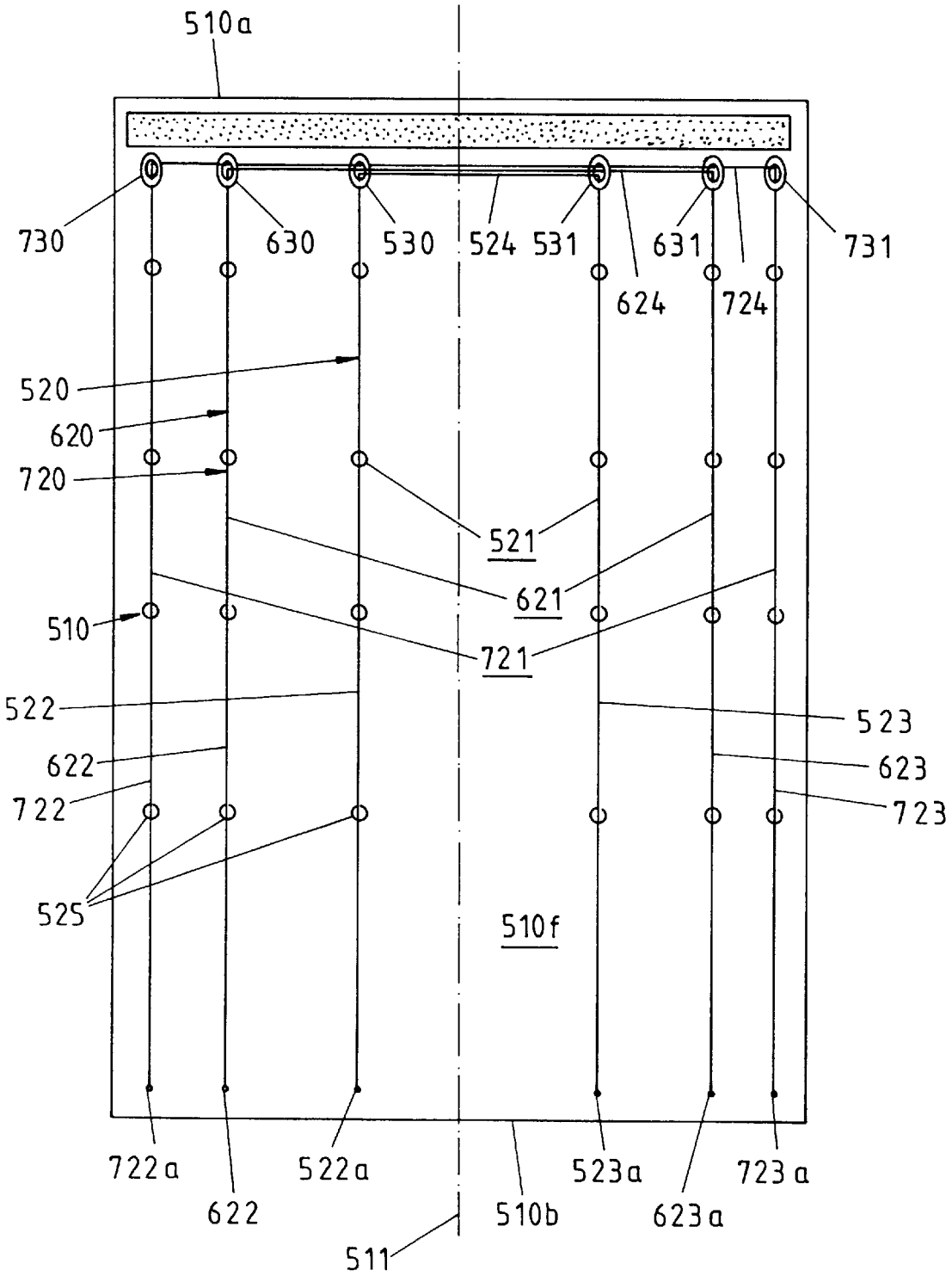
FIG. 24 shows a rear view of the drawn curtain with the drawing cords and the guiding and deflecting rings for the drawing cords of three drawing cord pairs.

The window shade 100' represented in the FIGS. 22,23 and 24 comprises a curtain 510 of a rectangular or square fabric black with the upper border edge 510*a*, the bottom border edge 510*b* and the two vertically proceeding lateral border edges 510*c*,510*d*. This curtain 510 is detachably affixed with its upper border edge to a mounting track 540, which is advantageously achieved with the aid of a Velcro fastener tape-like connection. It is possible, however, for differently constructed detachable connecting means, such as e.g. button type connections, zipper closing connections or the like to be made use of.

The front side of the curtain 510 is identified with 510*e* and the rear of the same with 510*f*. The center of the curtain 510 is identified by a longitudinal center line (FIG.24).

The gathering of the curtain 510 is effected with the aid of drawing cords 520 or 620 or 720, which are constructed in the form of drawing cord pairs 521 or 621 or 721. The number of the drawing cords depends in each case upon the width of the curtain 510. The drawing cords are always combined in pairs.

Each drawing cord 520,620,720 is, on the rear 510*f* of the curtain, retained with the aid of guide loops 525 on the curtain and follows a U-configured course, i.e. a course or routing pattern that corresponds to an inverted "U", while forming drawing cord sections 510*c*, 510*d* of the curtain 510, which are interconnected adjacent to the upper border edge 510*a* of the curtain by means of a drawing cord connecting section 524, in which case this drawing cord connecting section 524 proceeding parallel to the upper border edge 510*a* of the curtain 510 through guide rings 530,531, which are fastened adjacent to the upper border edge 510*a* of the curtain 510 on the same in such a way that preferably the two guide rings 530,531 for the drawing cord 520 are located on both sides of the longitudinal center line 511 of the curtain 510 (FIG.23).

The drawing cord sections 522,523 of the drawing cord pair 521, which constitutes the drawing cord 520, are, with their ends 522*a*,523*a*, adjacent to the lower border edge 510*b* of the curtain 510 attached to the same (FIG. 23).

The number of the drawing cords routed in a U-like fashion on the rear 510*f* of the curtain 510 depends in each case on the width of the curtain 510. In the embodiment example depicted in the FIGS. 23 and 24, the curtain 510 possesses three drawing cords 520,620,720, which are made up of the drawing cord pairs 521,621, 721. The drawing cords 620,720 are constructed so as to correspond to the drawing cord 520; they possess drawing cord sections 622,623 and 722,723 proceeding parallel to the lateral border edges 510*c*,510*d* of the curtain 510, which, adjacent to the upper border edge 510*a* of the curtain 510, are interconnected by means of drawing cord connecting sections 624,724. Adjoining the botttom border edge 510*b* of the curtain 510, these drawing cord sections 622,623 and 722,723 are, with their ends 622*a*,623*a*,722*a*,723*a*, attached to the curtain 510. All drawing cords 520,620,720 are routed in a U-configured fashion with the aid of a corresponding number of guide rings 630,631 and 730,731 secured to the curtain 510 adjacent to the upper border edge 510*a* of the same, in which case all guide rings 530,531 and 630,631 and 730,731 are disposed in series so that the drawing cord 520 is passed through the guide rings 530,531 and deflected, while the drawing cord 620 is passed through the guide rings 630,631 and defelcetd, in which case the drawing cord connecting section 624 proceeding parallel to the upper border edge 510*a* of the curtain 510 is at the same time additionally passed through the guide rings 530,531. The drawing cord 720 is also in an identical manner routed in a U-configured fashion, in which case the guiding and the deflecting is effected with the aid of the guide rings 730,731. The drawing cord connecting section 724 proceeding parallel to the upper border edge 510*a* of the curtain 510 of the drawing cord 720 is then additionally passed through the guide rings 630,631 and 530,531 so that, within the central area of the curtain 510, three driving cord connecting sections 524,624,724 (FIG.24) are located so as to be disposed closely to one another.

Figure 25:
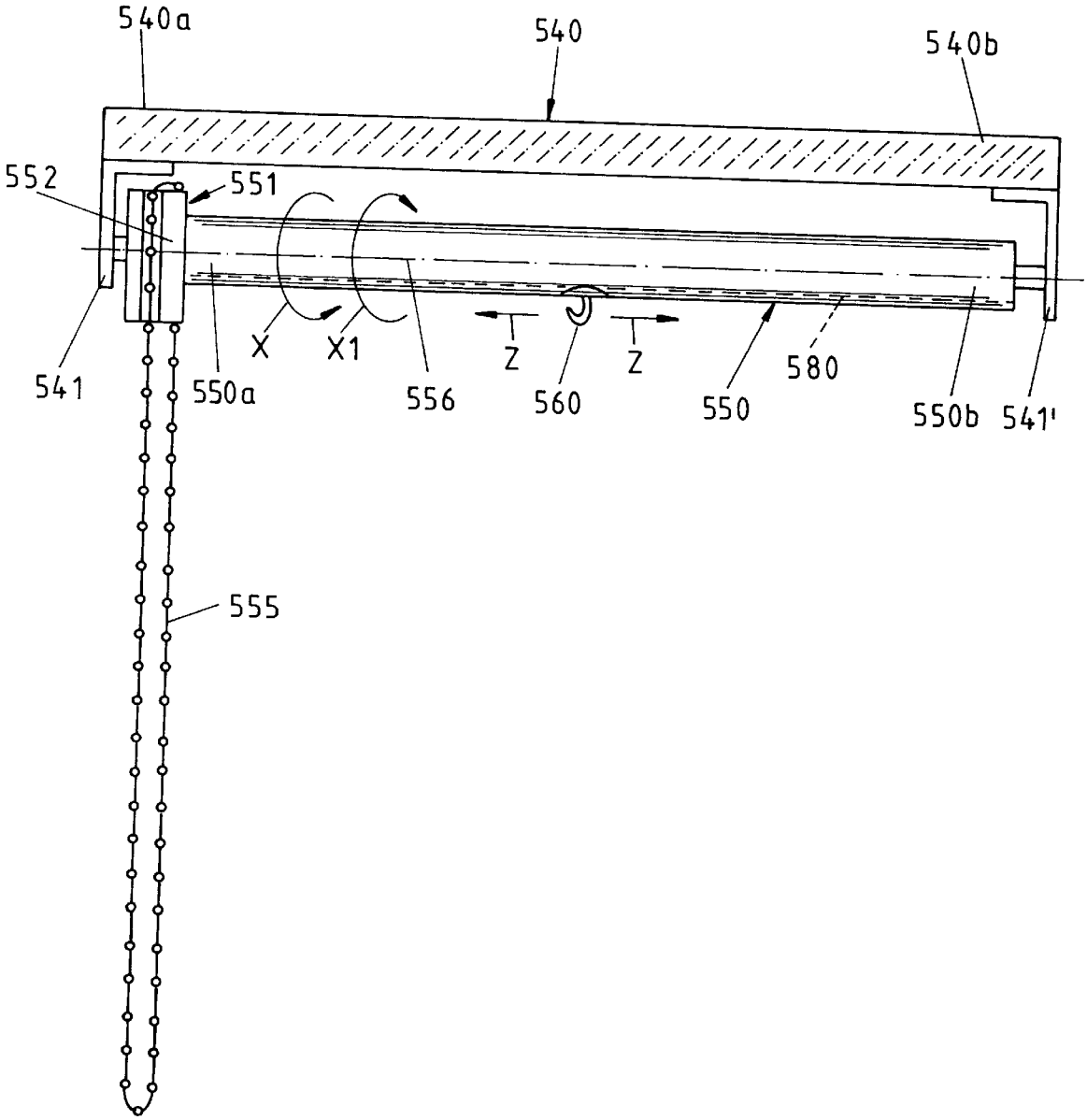
FIG. 25 shows a front view of the mounting track with the winding shaft bearing the drawing cord carrier for the drawing cords.

The mounting track 540 of the window shade 100' serves to anchor the same on a ceiling or a wall within a window area. The two ends 540*a*,540*b* of the rod-like mounting track 540 carry bearings 541,541' intended for a winding shaft 550 for the drawing cords 520,620,729 (FIG.25).

The winding shaft 550 for the drawing cords is constructed in the form of a cylindrical shaft body and is comprised of a hollow shaft or of a solid shaft. On the terminal areas 550*a*,550*b*, the winding shaft 550 carries bearing pins, which are supported in the bearings 541, 541' of the mounting track 540 so that the winding shaft 550 is rotatable about its shaft axis 556 in the direction X, X1. The operation of the winding shaft 550 is performed with the aid of a drive means 551 with the aid of an operating cord or operating chain 555, in which case also electromotive means may be employed, said cord or chain is being passed over a drum 552 of the drive means 551 disposed on the end 550*a* of the winding shaft 550. By drawing one or the other strand 555*a*,555*b* of the operating chain 555, the winding shaft is caused to rotate and this either in one direction or in the other direction.

On its circumference, the winding shaft 550 carries at least one pin or hook-shaped drawing cord carrier 560 which is, with its rotation area, located within the region of the drawing cord connecting section 524 or of the drawing cord connecting sections 624,724, which, in the drawn state of the curtain or shade 510, is out of engagement with the drawing cord connecting section or sections 524,624,724 and which, for winding the drawing cords 520,620,720 or their driving cord connecting sections 522,523 and 622,623 and 722,723 onto the winding shaft 550, during the curtain winding operation, seizes the drawing cord connecting sections 524, 624,724 while the winding shaft is in rotation.

As is depicted by FIG.23, the guide rings 530,531 and 630,631 and 730,731 for the drawing cords 520,620,720 are fitted to the curtain or shade 510 on both sides of the longitudinal center line 511 of the curtain 510 (FIG.24). In this way, on each side of the longitudinal center line 511 on the curtain 510, three guide rings, viz. 530,630,730 and 531,631,731 are affixed, in which case the distances of the two guide rings 530,531 for the drawing cord 520, of the guide rings 630,631 for the drawing cord 620 and of the guide rings 730,731 for the drawing cord 720 from the longitudinal center line 511 of the curtain 510 are identical.

Figure 30A:
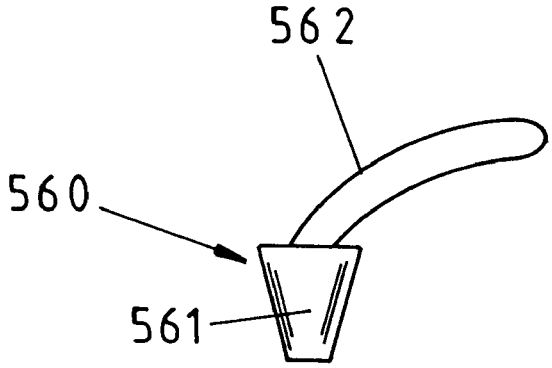
FIGS. 30A, 30B, 30C show different constructions of the drawing cord carrier possessing the configurations hooks, pins or pegs.
Figure 30B:
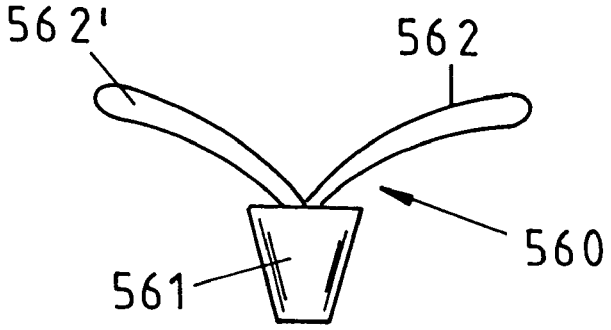
Figure 30C:
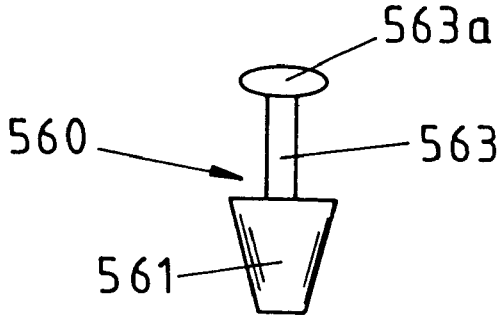

The drawing cord carrier 560 may possess the most widely varying constructions. According to an embodiment as per FIGS. 30A,30B and 30C, the drawing cord carrier 560 is comprised of a stopper or plug-like shaped member 561 which, as per FIG. 30A, is provided with a hook section 562 or, as per FIG. 30B, is provided with two oppositely directed hook-shaped sections 562,562'. Also the embodiment according to FIG. 30C is comprised of a stopper-like configured member 561, which supports a carrier pin 563, in which case this carrier pin 563 possesses, on its free end, a button-like enlarged portion 563*a* in order to be able to act as a carrier. The possibility also exists of providing the stopper-like shaped member 561 with a screw-like configured shaped or molded member, in which case the button-like construction of the screw-like shaped member has the function of a carrier. This construction of the drawing cord carrier 560 has the advantage that, on the one hand, the drawing cords are securely seized for the winding on operation and, during this operation. are also protected against a sliding or slipping off and, on the other hand, that an effortless unhooking from the from the drawing cords is ensured.

Inasfar as the drawing cord carriers 560 possess a stopper-configured member 561, the winding shaft 550 is provided on its circumference with a plurality of recesses or perforations, into which these stopper-configured members 561 of the drawing care insertes 560 are inserted. If these stopper-like members 561 are comprised of a springably elastic plastic, then the drawing cord carriers 560 are retained in the recesses or perforations provided in the wall of the shaft body of the winding shaft 550 with the aid of press or force fit. Additional connecting possibilities exist inas-much as this type of drawing cord carriers 560 is additionally protected by means of glueing. The carriers 560 in the embodiments as per FIGS. 30A,30B and 30C may be comprised of plastics, metallic materials or other suitable materials.

Figure 31:
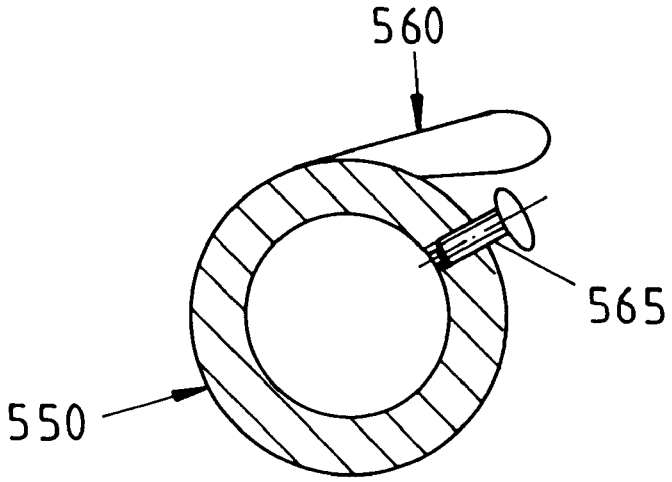
FIG. 31 shows a vertical section through the winding shaft with the drawing cord carrier formed onto the shaft body.

However, the possibility also exists of providing the shaft body of the winding shaft 550 with a drawing cord carrier 560 that is formed or molded onto the external circumference of the winding shaft 550 in such a way that a hook-like configuration results. In this embodiment, the drawing cord carrier 560 is in this case comprised of the same material from which also the winding shaft 550 is fabricated. FIG.31 also additionally shows a further embodiment inasmuch as, in the shaft body of the winding shaft 550, a carrier screw 565 is screwed in which possesses the same function as the pin or hook-like constructed drawing cord carrier 560. In this case, too, the possibility exists of securing the drawing cord carrier 560 with the aid of a screwed connection on the winding shaft 550. Also other embodiments of drawing cord carriers 560 than those illustrated in the drawings and described in the foregoing may be made use of. What is essential is that the drawing cord carrier 560 be secured to the external circumference of the winding shaft and that it possesses a construction, by virtue of which the drawing cord carrier 560 seizes the drawing cords for the winding procedure and is also able to release the same when the curtain or shade 510 is to be removed or detached from the mounting track.

According to the FIGS.26 through 29, the window shade 100' is employed as detailed in the following.

Figure 26:
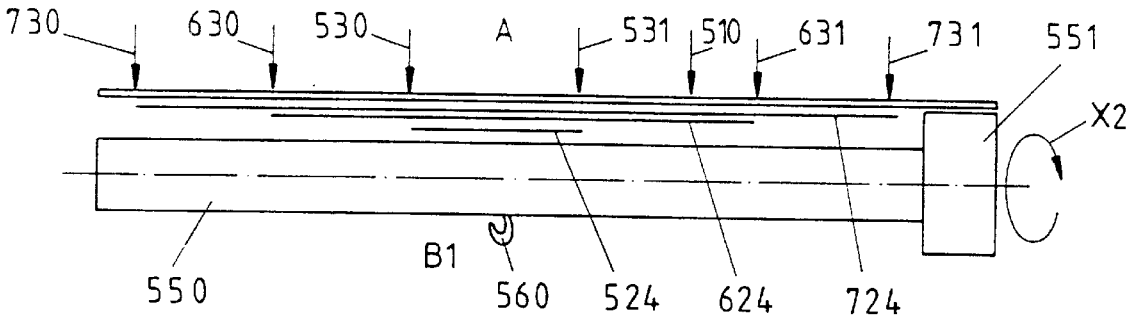
FIG. 26 shows a schematic view from above of the shade with the drawing cords and the winding cord carrier in the out-of-engagement position of the drawing cord carrier into the drawing cords with the shade drawn.
Figure 27:
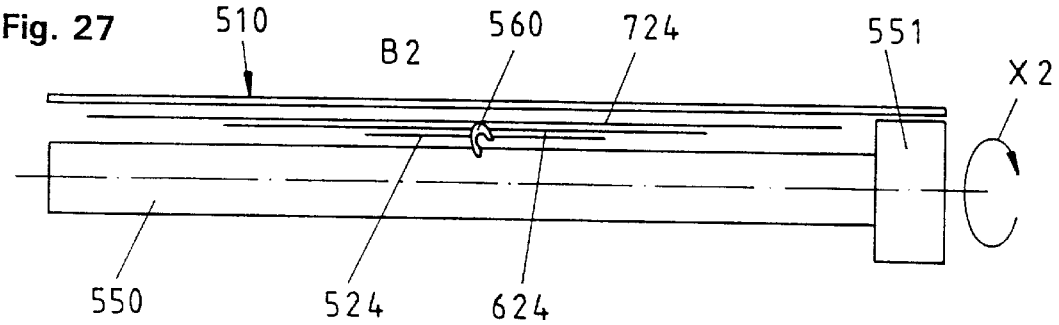
FIG. 27 shows a schematic view from above of the shade with the drawing cords and the winding shaft with the drawing cord carrier in the position of the drawing cord carrier shortly prior to the same engaging into the drawing cords.
Figure 28:
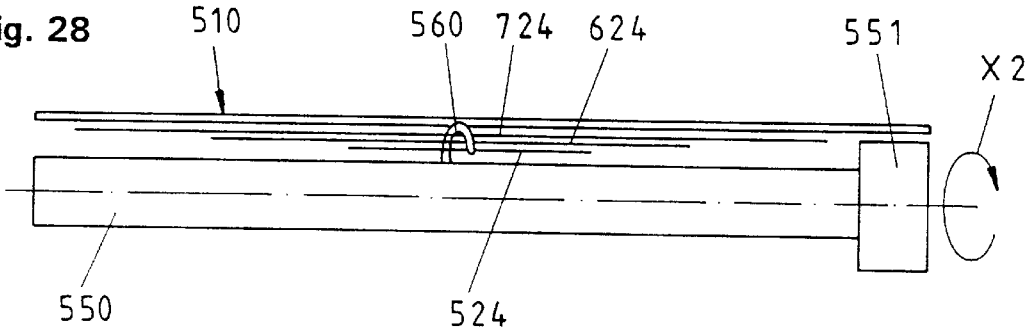
FIG. 28 shows a schematic view from above of the shade with the drawing cords and the winding shaft with the drawing cord carrier in the position of the drawing cord carrier subsequent to its engagement into the drawing cords.
Figure 29:
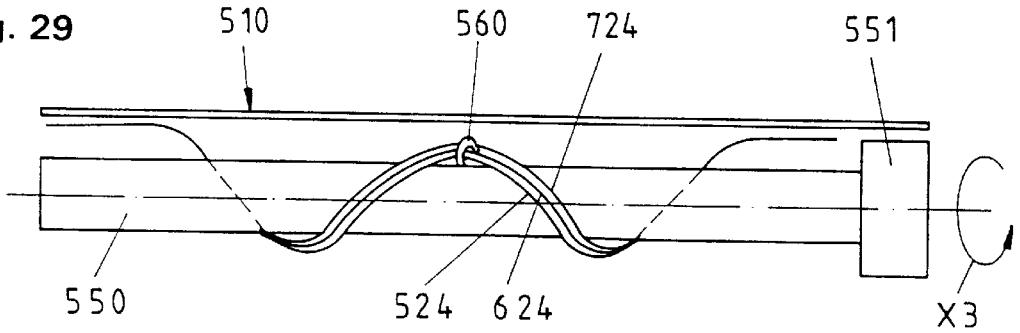
FIG. 29 shows a schematic view from above of the shade with the drawing cords and the winding shaft with the drawing cord carrier in the position of the winding shaft having been rotated further with seized drawing cords and entrained by the drawing cord carrier and already partly wound-on drawing cords during the gathering operation of the shade.

In the drawn state of the curtain 510, the drawing cord carrier 560 is out of the engagement position, that is to say that the drawing cord carrier 560 is located on the side facing away from the curtain 510 and is disengaged from the drawing cord connecting sections 524,624 724 within the region A (FIG.26). If the winding shaft 550 is now rotated with the aid of the operating chain 555 in the direction of arrow X2, then the drawing cord carrier 560 swings from the position B1 into the position B2 and seizes, from above, the drawing cord connecting sections 524,624,724 within the drawing cord section area A (FIG.27). The drawing cord carrier 560 is in this case constructed in a hook-like fashion in such a way that the drawing cord carrier engages from above into the drawing cord connecting sections 524,624, 724. Until the drawing cord carrier 560 engages into these drawing cord connecting sections of the drawing cords 520,620,720, the curtain 510 continues to assume its drawn position. If the winding shaft 550 is rotated further, then the drawing cord carrier 560 entrains the drawing cord connecting sections 524,624,724 of the drawing cords 520,620,720 (FIG.28), in which case, in the event of a further rotation of the winding shaft 550, the drawing cords 520,620,720 are wound onto the winding shaft 550, while the curtain 510 is gathered in the course of this winding procedure (FIG. 29).

When the gathering procedure of the curtain 510 is terminated, the window shade 100' assumes the position illustrated in FIG.40; the drawing cord carrier 560 is then still in its engagement or operative connection with the drawing cords 520,620,720 within the region of their drawing cord connecting sections 524,624,724.

When the rotational direction of the winding shaft 550 is changed and the same is rotated in the direction of arrow X3, in that case an unwinding of the drawing cords 520,620,720 from the winding shaft 550 takes place with the simultaneous performance of the drawing procedure of the curtain 510 so that, when the drawing or unwinding procedure of the curtain is terminated, i.e. when the curtain 510 assumes the stretched position depicted in the FIG. 24 the drawing cord carrier 560 is then passed out from the engagement region to the drawing cord connecting sections 524, 624, 724 of the drawing cords 520, 620, 720, i.e. the drawing cord carrier is no longer in operative connection with the drawing cords so that it is possible to separate, i.e. to detach the curtain 510 from its mounting track 540 of the window shade 100'.

In a construction of the window shade 100' as per FIG. 23, the drawing cord carrier 560 is disposed centrically on the winding shaft 550, i.e. within tb area of the longitudinal center line 11 of the curtain 510 since, within this area, on account of the disposition of the guide rings 530, 531 and 630, 631 and 730, 731, the drawing cord sections of the drawing cords 520, 620, 720 to be Seized by the drawing cord carrier 560 are located within the rotational area of said drawing cord carrier 560.

Figure 32:
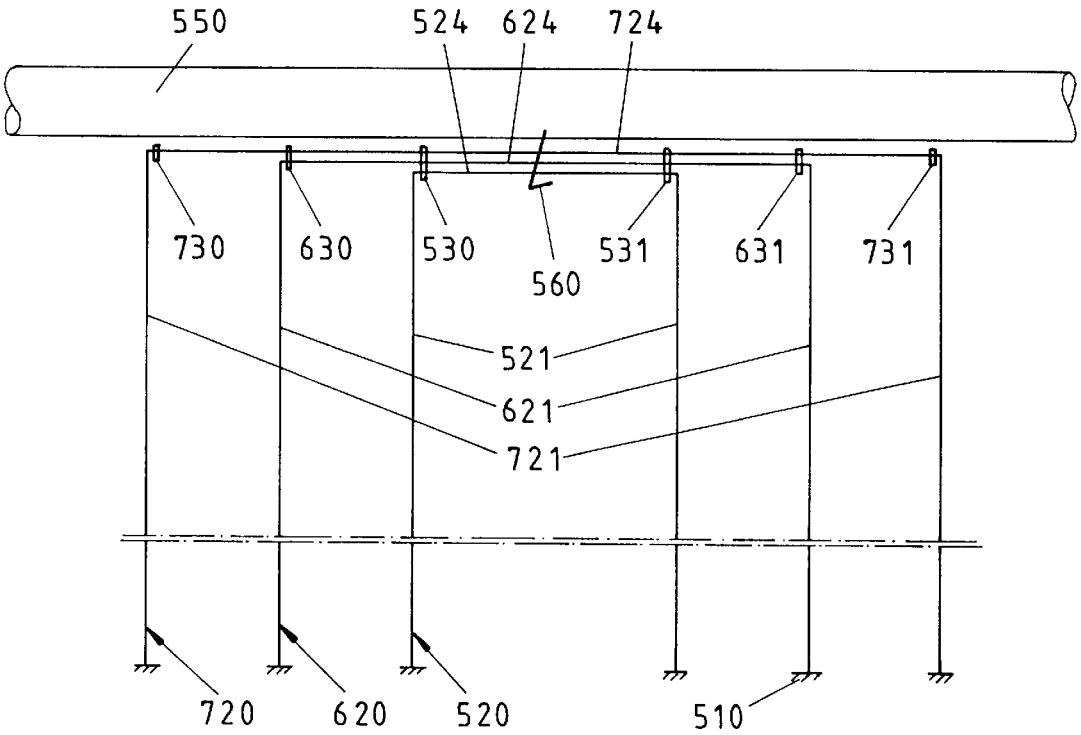
FIG. 32 shows a schematic view of a winding shaft with three interlocking pairs of drawing cords and with a drawing cord carrier.

In the winding shaft 550 for a window shade described in the foregoing and schematically depicted in FIG.32, three drawing cords 520,620,720 in the form of drawing cord pairs 521,621,721 are provided which are routed in a U-configured fashion and which are passed through guide rings arranged in pairs 530, 531 and 630, 631 and 730, 731 in such a way that, in each case, three drawing cord connecting sections 524,624,724 proceeding parallel to each other and to the longitudinal axis of the winding shaft 555 can be jointly seized by a single drawing cord carrier 560 mounted centrically on the winding shaft 550.

Figure 33:
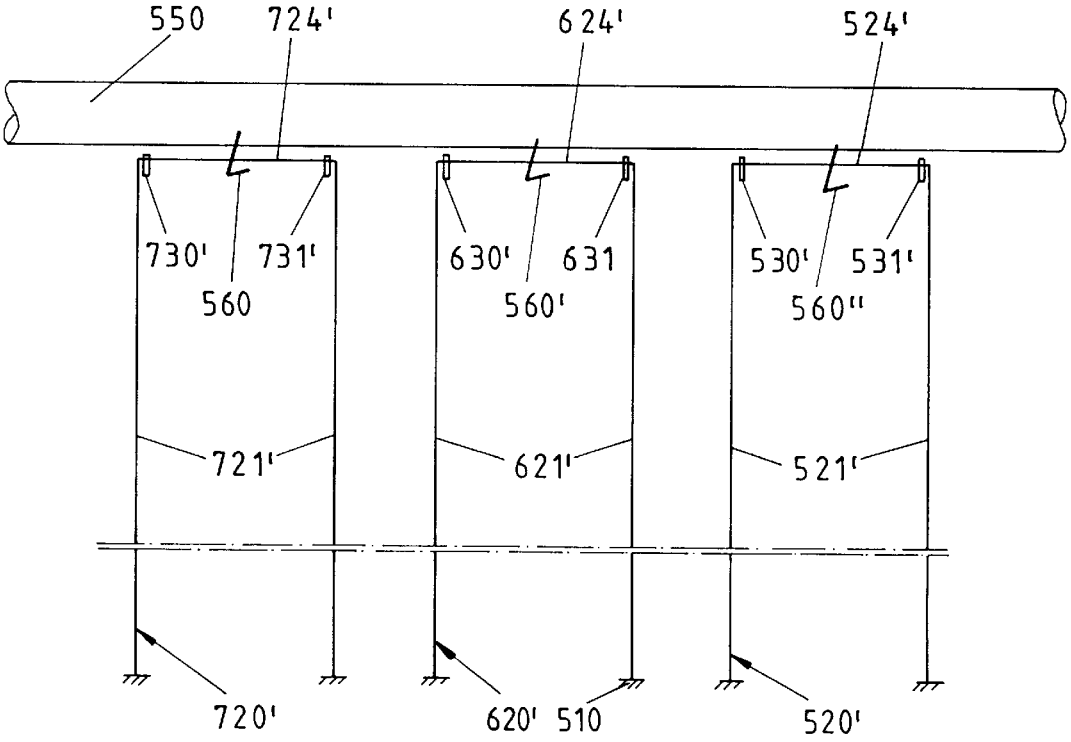
FIG. 33 shows a schematic view of a winding shaft with three drawing cord pairs disposed in a side-by-side arrangement with three drawing cord carriers.

On the other hand, according to a further embodiment as per FIG. 33, it is also possible for more than one drawing cord carrier 560 to be provided, in which case the number of the drawing cord carriers depends upon the number of U-like routed drawing cord pairs 521',621', 721' of three drawing cords 520'.620',720' and of pairs passed through guide rings 530',531' and 630', 631' and 730',731' combined into pairs. In this embodiment, the individual drawing cord pairs 521',621', 721' routed in a U-like fashion or pattern are disposed in a side-by-side arrangement so that the drawing cord connecting sections 524',624',724' proceeding parallel to the longitudinal axis of the winding shaft 550 are not, as in the embodiment as per FIG.32, superposed within the central area so that they can be seized by a single drawing cord carrier 560, but are disposed so as to be located in series so that, in order to be able to seize the drawing cord connecting sections 524',624',724', three drawing cord carriers 560,560', 560"" are provided, of which each drawing cord carrier is disposed centrically relative to the respective drawing cord connecting sections 524',624',724' on the winding shaft 550. The minimum number of drawing cord pairs routed in a U-like fashion for the curtain 510 should be two.

The drawing cord carrier 560 can be rigidly or also detachably mounted on the winding shaft 550. Particularly advantageous is in this connection the construction, according to which, as per FIG.25, the winding shaft 550 is, on its circumference, provided with a longitudinal slot 580, e.g. in the form of a guide groove, which accommodates the slide-shaped drawing cord carrier 560 and ensures a longitudinal displacement, which is indicated by the arrows Z. By virtue of this design, the possibility exists of disposing on the winding shaft 550, and this in adaptation to the respective requirements, a pertinent and requisite number of drawing cord carriers 560, in which case, due to the displaceability of the drawing cord carriers 560, their distances can be adapted to the drawing cord sections to be seized. Moreover, the possibility exists, apart from a centrical disposition of a single drawing cord carrier 560 on the winding shaft 550, of being able to also effect an off center disposition of the drawing cord carriers, should this be necessary.

Apart from the employment of a single winding shaft 550, the possibility also exists of disposing, on the terminal areas of the mounting track 540, two winding shafts, which are constructed in the form of short shafts and which, in the same manner as the winding shaft 550, can be provided with drawing cord carriers 560. The length of the two winding shafts can be randomly selected. It will substantially depend upon the width of the curtain 510. Each of the two windind shafts is provided with an operating cord or an operating chain 555. It is also possible for controllable electromotive drive means to be operatively connected with the winding shafts.

By employing two winding shafts possessing short lengths, the possibility is provided of gathering or of fanning out the curtain with a simple technique and without any substantial technical effort or costs. The employment of a thusly designed window shade is consequently also possible in the case of gable windows and with horizontal semicircular arches and wherever a winding shaft, whose length is dimensioned in correspondence with the width of the curtain cannot be fitted.

What is claimed is:

1. A curtain, comprising a plurality of guiding and deflecting elements attached to a curtain fabric for a plurality of drawing cords, wherein a plurality of curtain fabric bearing attachment plates having a plurality of rings is secured with the aid of an adhesive closing tape to a mounting track rigidly connected with a building, wherein said plurality of attachment plates provide a frictionally operative, detachable connection with said mounting track for absorbing vertical tensile forces, said plurality of attachment plates comprising a horizontally extended web and said mounting track comprising a horizontally extending engagement groove, said web and said engagement groove located opposite each other and, in the connected state, said web engaging said engagement groove, said attachment plates and said mounting track each comprising said adhesive closing tape.

2. The curtain of claim 1, wherein said web is secured to said attachment plate at a point above said ring and at a point below said adhesive tape.

3. The curtain of claim 1, wherein said engagement groove is located on said mounting track at a point below said adhesive closing tape.

4. The curtain of claim 1, wherein said web is molded onto said attachment plate.

5. The curtain of claim 1, wherein said engagement groove has a depth which substantially corresponds to the width of said web on said attachment plate.

6. The curtain of claim 1, wherein said engagement groove has a height which substantially corresponds to the thickness of said web on said attachment plate.

7. The curtain of claim 1, wherein said mounting track is hollow and comprises two adjoining lateral surfaces, said surfaces comprising an aperture for receiving attachment means for fixedly anchoring said mounting track onto a wall, wherein said mounting track further comprises a lateral area opposite said lateral surfaces, said lateral area comprising an engagement groove extending in the direction of said mounting track.

8. The curtain of claim 1, wherein said mounting track comprises a cross-sectional web structure, said cross-sectional web structure comprising a first channel section with horizontally proceeding upper and lower legs and further comprising a web-connecting leg that connects said first channel to a lower section located below said lower leg, wherein said upper leg forms a top section that extends beyond said web-connecting leg, and second end of said upper and lower legs form an angled section facing inwards, said lower leg further forming an angled section facing downwards, wherein said cross-sectional web structure further comprises an engagement groove at a bottom portion of said lower section, said lower section further comprising an aperture at its lower portion.

9. The curtain of claim 8, wherein said mounting track further comprises a channel section that extends beyond said lower section, said channel section having a length that corresponds to the thickness of a fastener tape section of said adhesive closing tape mounted on said mounting track.

10. The curtain of claim 1, further comprising a winding shaft rotatably supported on said mounting track, said winding shaft being located at a point close to the upper edge of said curtain, wherein said winding shaft comprises a drive means being operated by a plurality of operating cords, said winding shaft further comprising a plurality of drawing cords passing through said guide rings and being secured to bottom edge of said curtain.

11. The curtain of claim 10, further comprising a drawing cord carrier, said drawing cord carrier being located on the circumference of said winding shaft.

12. The curtain of claim 11, wherein said drawing cord passes through two of said guide rings, wherein said drawing cords being secured by said cord carrier when said curtain is rotatably rolled around said winding shaft.

13. The curtain of claim 11, wherein said drawing cords from a plurality of drawing cord sections extend across said curtain, said drawing cord sections being connected by drawing cord connecting sections, said drawing cord connecting sections being parallel to the upper edge of said curtain.

14. The curtain of claim 10, wherein two of said guide rings are located in the central portion of said curtain.

15. The curtain of claim 11, wherein three of said guide rings are provided on right hand side of said curtain's center and three of said guide rings are provided on left hand side of said curtain's center.

16. The curtain of claim 15, wherein each guide ring on the right of said curtain's center corresponds to one of said guide rings on the left of said curtain's center, wherein each corresponding pair of said guide ring in equi-distanced from the curtain center.

17. The curtain of claim 11, wherein said cord carrier is a hook-like structure.

18. The curtain of claim 11, wherein said cord carrier comprises a stopper having a hook-shaped portion, said winding shaft further comprises a recess portion, said stopper being located in said recess of said winding shaft.

19. The curtain of claim 10, wherein said curtain is detachably fixed to said mounting track with a hook and loop fastening device.

20. The curtain of claim 13, wherein the total number of said drawing cord carriers equals the number of said drawing cord sections.

21. The curtain of claim 10, wherein said winding shaft comprises at least one short shaft, said short shaft being shorter than the width of said curtain, said winding shaft being attached to said mounting track.

22. The curtain of claim 1, wherein said attachment plate and said rings are constructed from polyamide.

* * * * *